US005290373A

United States Patent [19]

Donahue et al.

[11] Patent Number: 5,290,373

[45] Date of Patent: Mar. 1, 1994

[54] EVAPORABLE FOAM CASTING SYSTEM UTILIZING AN ALUMINUM-SILICON ALLOY CONTAINING A HIGH MAGNESIUM CONTENT

[75] Inventors: Raymond J. Donahue, Fond du Lac; Terrance M. Cleary, Allenton; William G. Hesterberg, Rosendale, all of Wis.

[73] Assignee: Brunswick Corporation, Skokie, Ill.

[21] Appl. No.: 52,170

[22] Filed: Apr. 23, 1993

[51] Int. Cl.[5] ..... C22F 1/04

[52] U.S. Cl. ..... 148/549; 123/195 R; 148/700; 148/702; 148/415; 148/437; 148/438; 148/439; 148/440; 164/34; 164/35; 420/534; 420/546

[58] Field of Search ..... 148/549, 700, 702, 415, 148/437, 438, 439, 440; 420/534, 546; 164/34, 35; 123/195 R

[56] References Cited

U.S. PATENT DOCUMENTS

| | | | |
|---|---|---|---|
| 4,603,665 | 8/1986 | Hesterberg et al. | 123/195 R |
| 4,821,694 | 4/1989 | Hesterberg et al. | 123/195 R |
| 4,966,220 | 10/1990 | Hesterberg et al. | 164/34 |
| 4,969,428 | 11/1990 | Donahue et al. | 123/195 R |

*Primary Examiner*—R. Dean
*Assistant Examiner*—Robert R. Koehler
*Attorney, Agent, or Firm*—Andrus, Sceales, Starke & Sawall

[57] ABSTRACT

A method of evaporable foam casting of metal articles, such as engine blocks for internal combustion engines. An evaporable foam pattern having a configuration proportionally identical to the article to be cast is positioned in a mold and a finely divided flowable material, such as sand, surrounds the pattern and fills the internal cavities of the pattern. A molten hypereutectic aluminum-silicon alloy containing 16% to 19.5% by weight of silicon and containing a magnesium content in excess of the magnesium solid solubility limit, is fed into the mold and into contact with the pattern. The heat of the molten metal vaporizes the pattern, with the vapor being trapped within the sand and the molten metal filling the void created by vaporization of the pattern to provide a cast article. The high magnesium content in the alloy produces in the solid state a $Mg_2Si$ phase in the eutectic and in the molten state an insulating magnesium oxide surface film which decreases the chilling of the molten metal front and prevents the liquid styrene defects resulting from degradation of the polymeric material.

10 Claims, 2 Drawing Sheets

EVAPORABLE FOAM CASTING SYSTEM UTILIZING AN ALUMINUM-SILICON ALLOY CONTAINING A HIGH MAGNESIUM CONTENT

BACKGROUND OF THE INVENTION

Aluminum-silicon alloys containing less than about 11.6% by weight of silicon are referred to as hypoeutectic alloys and have seen extensive use in the past. The unmodified alloys have a microstructure consisting of primary aluminum dendrites, with a eutectic composed of acicular silicon in an aluminum matrix. However, the hypoeutectic aluminum-silicon alloys lack wear resistance.

On the other hand, hypereutectic aluminum-silicon alloys, those containing more than about 11.6% silicon, contain primary silicon crystals which are precipitated as the alloy is cooled between the liquidus temperature and the eutectic temperature. Due to the high hardness of the precipitated primary silicon crystals, these alloys have good wear resistant properties, and while alloys of this type have good fluidity, they have a relatively large or wide solidification range. The solidification range, which is a temperature range over which the alloy will solidify, is the range between the liquidus temperature and the invariant eutectic temperature. The wider the solidification range, the longer it will take for an alloy to solidify at a given rate of cooling. Thus, for casting purposes, a narrow solidification range is desired.

As a general rule, hypereutectic aluminum-silicon alloys are more difficult to case than hypoeutectic aluminum-silicon alloys because hypereutectic aluminum-silicon alloys are difficult to "feed" and this casting characteristic worsens as the silicon content increases. Thus, hypereutectic aluminum-silicon alloys containing 16% to 20% silicon have greater opportunity of finding commercial use than hypereutectic aluminum-silicon alloys containing more than 20% silicon (such as the class containing 21% to 25% silicon) because they have a narrower solidification range which produce less shrinkage microporosity and inherently a smaller primary silicon particle size. The smaller primary silicon size results in better machinability and is advantageous in wear applications. The absence of shrinkage microporosity in the cylinder bores of 4-stroke internal combustion engines is essential for low oil consumption.

Typical wear resistant aluminum-silicon alloys are described in U.S. Pat. No. 4,603,665. U.S. Pat. No. 4,603,665 describes a hypereutectic aluminum- silicon casting alloy having particular use in casting engine blocks for marine engines. The alloy of that patent is composed by weight of 16% to 19% silicon, 0.4% to 0.7% magnesium, less than 0.37% copper, and the balance aluminum. The alloy has a narrow solidification range providing the alloy with excellent castability, and as the copper content is maintained at a minimum, the alloy has improved resistance to salt water corrosion.

It has also been recognized in the metallurgical field that the magnesium content of the aluminum silicon alloy should be maintained below its solubility limit, because there is no heat treatment response benefit in going to a higher magnesium content. Moreover, a higher magnesium content also has an adverse effect on melt handling, as well as producing a decrease in fluidity, which can contribute to making castings with defects.

The solubility limit of magnesium in an aluminum-silicon alloy varies with the chemistry. For example, the solubility limit of magnesium in hypoeutectic aluminum-silicon alloys that do not have other alloying elements, other than magnesium, is 0.80%. However, the addition of other alloying elements, such as copper. manganese and iron, to the alloy can reduce the solubility limit of magnesium to a value of about 0.70%.

If the magnesium content is above the solubility limit, the compound $Mg_2Si$ is produced, which results in increased brittleness in the alloy, and it is well recognized that the insoluble $Mg_2Si$ phase should be avoided. For example, the 9th Edition of The *Metals Handbook*, Vol. 15, September 1989, p.746, states "The hardening phase $Mg_2Si$ displays a useful solubility limit corresponding to approximately 0.70% magnesium, beyond which no further strengthening occurs or matrix softening takes place".

Evaporable foam casting is a known technique, in which a pattern is formed of an evaporable polymeric material, such as polystyrene, having a configuration substantially identical to the part to be cast. The pattern is normally coated with a ceramic wash coat, which prevents metal sand reaction and facilitates cleaning of the cast metal part. The pattern containing the wash coat is supported in the mold and surrounded by an unbonded particulate medium, such as sand. When the molten metal contacts the pattern, the foam material in various fractions, melts, vaporizes, and decomposes with the liquid and vapor products of degradation passing into the interstices of the sand, while the molten metal replaces the void created by vaporization of the foam material to thereby form a cast article identical in shape to the pattern. In the evaporable foam casting art, it has generally not been recognized that the molten metal is in direct contact with the liquid foam decomposition products for a significant portion of the process, and therefore, if the molten metal is reactive enough due to its alloy content of reactive elements, the molten metal can react with the liquid foam products and alter the resulting volume fraction of reaction products.

In an evaporable foam casting process, it is desirable to slow the mold filling process by the permeability of the coating on the foam to provide ample time for the elimination of vapors generated by the decomposition of the pattern from the molten alloy. It has been found that when casting large articles, such as engine blocks, a defect commonly referred to as a "liquid styrene defect" can occur with hypereutectic aluminum-silicon alloys, that are not necessarily found with hypoeutectic aluminum-silicon alloys. The defect appears as elongated rifts and may extend through the thickness of the casting. It is believed the liquid styrene defect results because the liquid styrene that accumulates on the advancing metal front stays liquid longer than the metal, particularly when two molten metal streams meet in the far reaches of a complex casting and have lost a significant portion of their initial super heat. Even after solidification, the solidified metal continues to transfer heat to the liquid styrene, eventually causing its evaporation and creating a void in the space previously occupied by the liquid styrene. As an engine block is subjected in use to internal pressures, leakage can occur through the defect.

Attempts have been made in the past to eliminate this liquid styrene defect by using coatings of different permeabilities and by increasing the temperature of the molten alloy, but these attempts have not eliminated the defect. It has also been suggested to remove the copper from aluminum alloy 390 (16%–18% silicon, 4.5% copper), to eliminate the bottom half of the solidification range of that alloy and narrow the solidification range, but again, a change in the solidification range has not had an influence in controlling the liquid styrene defect. The use of reactive ingredients in the wash coating has been suggested, but the attempts have not been successful. The paradigm that exists with the evaporable foam casting process is that there is believed to be a vapor gap between the molten metal and the liquid products of foam decomposition, and therefore no chemical reaction is expected between the molten metal, even if it is reactive, and the liquid foam products of decomposition. In essence, it is generally not accepted that the liquid metal and liquid styrene are in direct contact as described above.

SUMMARY OF THE INVENTION

The invention is directed to a method of evaporable foam casting of hypereutectic aluminum silicon alloys, and in particular, to casting articles of large, complex configurations, such as internal combustion engine blocks that will not contain the liquid styrene defect.

The alloy to be used in the casting method of the invention is a hypereutectic aluminum-silicon alloy containing in the range of 16% to 19.5% by weight of silicon. The alloy also contains magnesium in the range of 0.75% to 5.0% by weight and in an amount in excess of its solubility limit. With the excess magnesium the microstructure of the cast alloy includes an unmodified eutectic plus a "constitutionally" modified eutectic made in part of the $Mg_2Si$ phase.

In the casting procedure, a pattern, having a configuration proportionally identical to the article to be cast and composed of an evaporable polymeric material, such as polystyrene or polymethylacrylate, is initially coated with a ceramic wash coat and is then placed in a mold. A freely flowable, particulate material, such as sand, which includes silica, chromite, zircon, olivine and carbon sand, surrounds the pattern as well as filling the internal cavities of the pattern.

When the molten alloy contacts the foam pattern in the mold, the heat of the alloy will degrade the foam material to vaporize the foam, with the products of the foam decomposition passing into the interstices of the surrounding sand and the molten alloy filling the void created by the vaporization of the foam material to provide a cast article.

It has been unexpectedly discovered that the high magnesium content of the alloy prevents the formation of the liquid styrene defect. It is believed that the high magnesium content results in the composition of the alloy being inherently reactive to the local environment of the decomposing foam, thereby causing an insulating magnesium oxide film to form on the advancing metal front that mitigates the chilling of the advancing metal front, and allowing the liquid products of foam decomposition to escape before the leading edge of the molten metal solidifies.

The use of the high magnesium content, above its solubility limit in the alloy, is unobvious, for it has been previously thought that a magnesium content above its solubility limit has no strengthening effect and would normally be expected to produce melt handling problems, as well as the loss of fluidity in the alloy. Also since there is supposed to be an insulating gaseous gap between the advancing molten metal and the receding liquid products of foam decomposition, no chemical reaction is expected between the molten metal and the liquid foam products of decomposition with the current understanding of the evaporable foam casting process. Thus, the result achieved by using a magnesium content above its solubility limit is totally unexpected from the prior art.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
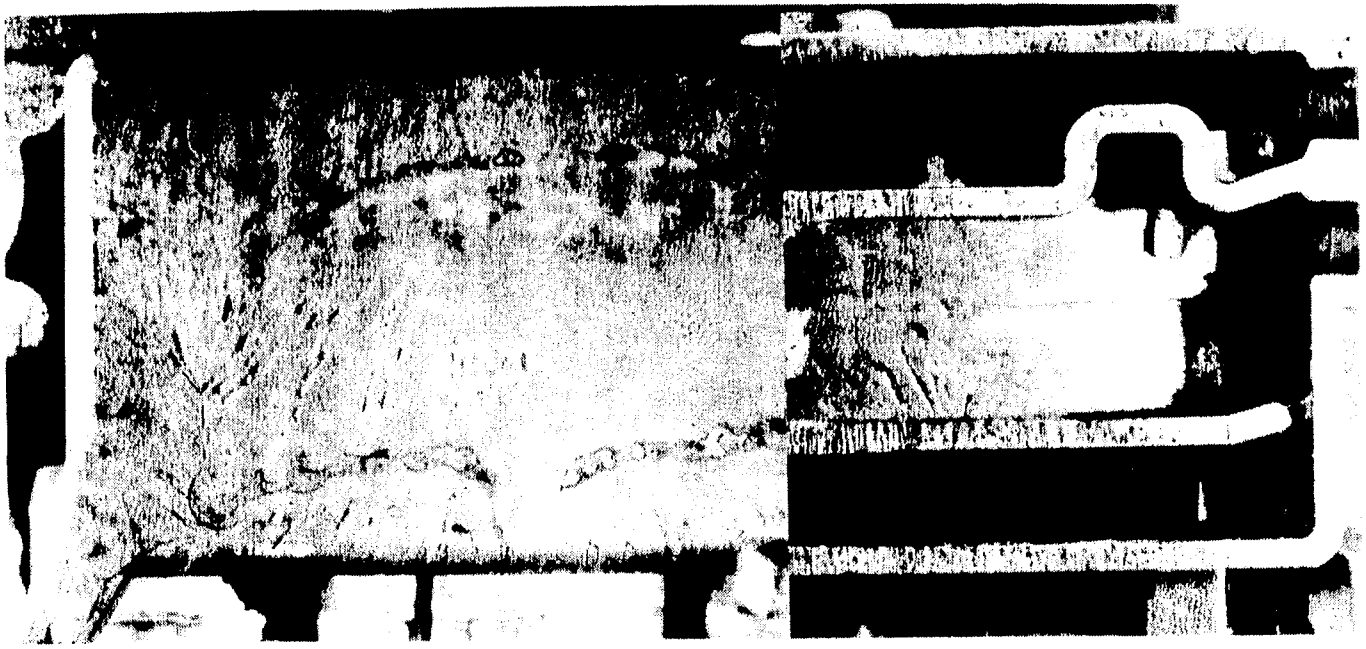
FIG. 1 is a is a photograph of a cast hypereutectic aluminum-silicon alloy water/exhaust cover for an outboard, two-cycle engine at one-third reduction showing a "liquid styrene defect"

The invention is directed to an evaporable foam casting system utilizing a hypereutectic aluminum-silicon alloy whose silicon range is centered about 18% silicon, the range of greatest fluidity, and has particular application for casting articles of substantial and complex sizes, such as linerless engine blocks for internal combustion engines.

The alloy to be used in the casting system is a hypereutectic aluminum-silicon alloy containing from 16% to 19.5% silicon. The lower limit is established at 16% silicon because below 16% silicon the fluidity drops below 30 inches of fluidity (in the spiral test when cast at 1400° F.) and the wear resistance of the alloy drops below the level sufficient for cylinder bore wear applications due to the small volume fraction of primary silicon. The upper limit is established at 19.5% silicon because above 19.5% silicon the fluidity again drops below 30 inches of fluidity (in the spiral test when cast at 1400° F.). In addition, the alloy has a relatively high magnesium content in the range of 0.75% to 5.0%, with the magnesium being present in an amount in excess of its solubility limit in the alloy, so that in the cast alloy the microstructure includes an unmodified eutectic and a constitutionally modified eutectic made up in part of the $Mg_2Si$ phase.

More particularly, the casting alloy can be composed of a hypereutectic aluminum-silicon alloy having the following composition in weight percent:

| | |
|---|---|
| Silicon | 16.0%–19.5% |
| Magnesium | 0.75%–5.0% |
| Iron | Less than 1.45% |
| Manganese | Less than 0.30% |
| Copper | Less than 0.37% |
| Aluminum | Balance |

The casting alloy can also be composed of a hypereutectic aluminum-silicon alloy having the following composition in weight percent:

| | |
|---|---|
| Silicon | 17.0%–19.0% |
| Magnesium | 0.8%–3.0% |
| Iron | Less than 1.4% |

-continued

| | |
|---|---|
| Manganese | Less than 0.3% |
| Copper | Less than 0.37% |
| Aluminum | Balance |

The magnesium is used in an amount in excess of its solubility limit in the alloy and the specific amount of magnesium will vary, depending upon the silicon content and the alloying additions. For example, with a hypereutectic aluminum-silicon alloy containing no other alloying elements, except magnesium, the solubility limit of magnesium will be about 0.80%. Thus, the magnesium content in the alloy should be in excess of that value. With hypereutectic alloys containing additional alloying elements, such as manganese, iron and copper, the solubility limit of magnesium may be in the range of about 0.7%, so that the magnesium content in the alloy should be in excess of that value.

The evaporable foam pattern to be used in the casting process is formed from a polymeric material, such as polystyrene or polymethylmethacrylate or a combination of the two, and has a configuration proportional identical to the article to be cast. The foam pattern is normally coated with a porous ceramic material, which tends to prevent metal/sand reaction and facilitates cleaning of the cast metal part. The ceramic coating can be applied by immersing the pattern in a bath of the ceramic wash, draining the excess wash from the pattern and then drying the wash to provide the porous ceramic coating.

The coated pattern is supported in a mold and an unbonded finely divided flowable material, such as silica, chromite, zircon, olivine, or carbon sand, is introduced into the mold and surrounds the pattern, as well as filling the cavities in the pattern.

The molten alloy at a temperature below 1600° F., and generally at a temperature in the range of 1300° F. to 1400° F., is introduced through one or more sprues into the mold and into contact with the polymeric pattern. The heat of the molten metal will melt, vaporize, and decompose in various fractions the polymeric sprue, as well as the pattern, with the resulting products passing through the porous ceramic coating and into the interstices of the surrounding sand. The molten metal will occupy the void created by vaporization of the pattern to produce a cast metal article substantially identical in configuration to the pattern.

Figure 2:
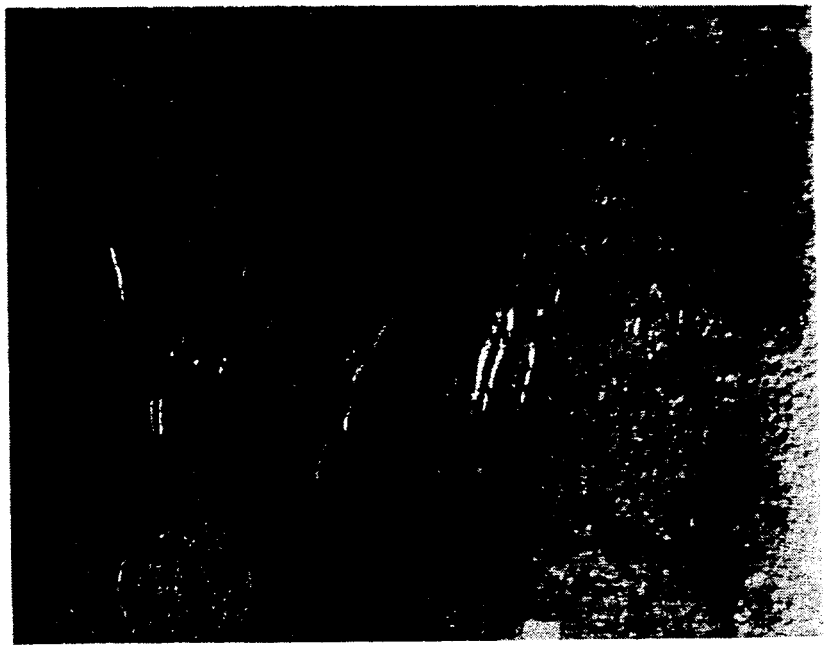
FIG. 2 is a 2× enlargement of a portion of the casting shown in FIG. 1.
Figure 3:
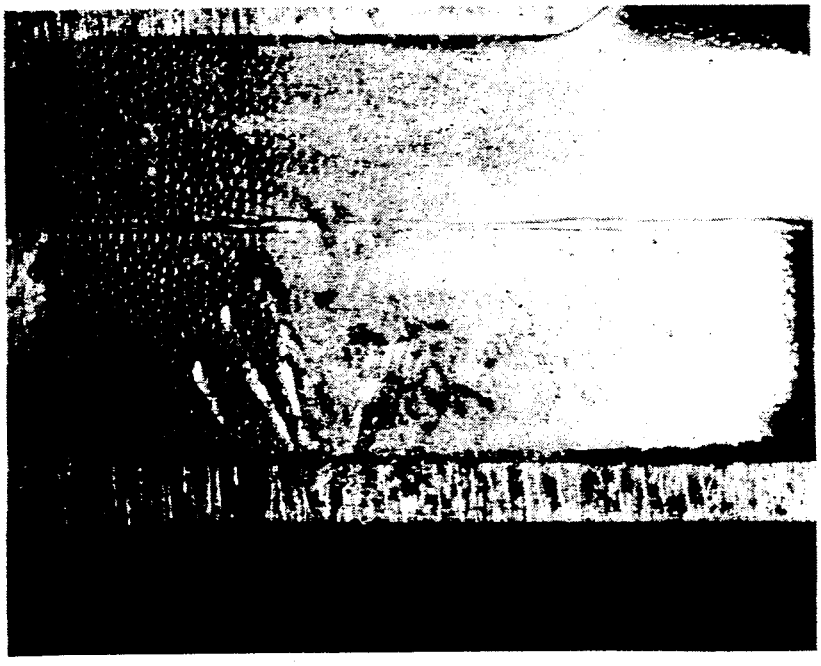
FIG. 3 is a 2× enlargement of a second portion of the casting shown in FIG. 1.

It has been noted in the past that when casting large articles of complex configuration, such as engine blocks, having multiple ingating that defects referred to as "liquid styrene defects" can occur, as illustrated in the drawings. As best seen in the enlargements of FIGS. 2 and 3, the defects can be several inches long and in cross section extend through the thickness of the casting. As a cast engine block is subjected to high internal pressures in service, pressure leaks can occur in the area of a liquid styrene defect.

It is believed that the "liquid styrene defects" occurs where the streams of molten metal contact the polymeric foam pattern, progressively liquefying the foam material, and the molten metal is solidified before the liquid polymeric material can vaporize and escape into the surrounding sand. The subsequent vaporization leaves a void or rift which can result in the "liquid styrene defect".

It was previously thought that the "liquid styrene defect" could be minimized or eliminated by casting at a higher temperature. Unfortunately, casting at a higher temperatures did not solve the problem.

It was further believed that the defect could possibly be overcome by utilizing an alloy with a narrow solidification range, such as by altering the silicon or copper content of the alloy. Again, a narrowing of the solidification range did not have an influence in controlling the "liquid styrene defect". Attempts have also been made to eliminate the defect by incorporating reactive ingredients, i.e. reducing or oxidizing constituents, in the wash coat. However, these attempts have been unsuccessful.

In accordance with the invention, it has been found that high additions of magnesium, above its solubility limit in hypereutectic aluminum silicon alloys show a dramatic effect in eliminating the "liquid styrene defect". The high addition of magnesium produces what appears to be a "constitutionally modified" eutectic, along with an unmodified eutectic. For example, a traditional hypereutectic aluminum-silicon alloy containing magnesium in an amount less than its solubility limit has a microstructure consisting of primary silicon particles embedded in a matrix of unmodified eutectic. The unmodified eutectic consists of continuous aluminum and silicon phases with the aluminum comprising about 90% of the eutectic. On the other hand, a high magnesium hypereutectic alloy, containing magnesium above its solubility limit consists of primary silicon particles embedded in a matrix composed of a "constitutionally" modified eutectic along with an unmodified eutectic. The "constitutionally" modified eutectic also includes relatively coarse particles of $Mg_2Si$ which are formed by magnesium combining with a portion of the silicon in the eutectic. It has been recognized that "impurity" modification of aluminum-silicon alloys occurs with an increase in microporosity. This concern would discourage one skilled in the art from attempting a high magnesium addition, because the increased magnesium would not be expected to improved mechanical properties, and yet could lead to microporosity.

As previously discussed, the presence of $Mg_2Si$ particles in the microstructure would normally be expected to lead to melt handling difficulties and increased brittleness in the cast alloy. In spite of the less ductile nature of the alloy having a microstructure containing the $Mg_2Si$ phase in the eutectic, the high magnesium aluminum-silicon alloy can be cast in an evaporable foam process to produce articles that show a significant reduction in the "liquid styrene defect" and a pressure tightness improvement. This result is unexpected and unobvious.

The mechanism by which the high addition of magnesium eliminates the "liquid styrene defect" in evaporable foam casting processes is believed to be understood. It is believed that the high magnesium composition results in an alloy that is inherently reactive to the local environment of the decomposing foam as may be apparent from the standard free energy of formation of various metal oxides as a function of temperature, which indicates MgO has a lower free energy formation than $Al_2O_3$. The selective oxidation and loss of magnesium from the advancing melt front causes an insulating magnesium oxide film to form on the advancing molten metal front that retards the chilling of molten metal at the front sufficiently to allow the liquid products of foam decomposition to escape before the leading edge of the molten metal solidifies. Without high magnesium levels, conventional hypereutectic aluminum-silicon alloys, which contains 16% to 18% silicon, exhibit a sharp maximum in fluidity at 18% silicon. The high fluidity at the 18% silicon content is considered an advantageous casting attribute for these hypereutectic aluminum-silicon casting alloys which inherently are difficult to feed. Clearly, the 16% to 18% composition specification for silicon capitalizes on the unusual peak in the fluidity, and is the reason why these hypereutectic aluminumsilicon alloys are the most popular and useful alloys of any of the hypereutectic aluminum-silicon alloys. However, it is believed that this high fluidity permits entrapment of liquid styrene in the molten aluminum alloy and this contributes to the formation of the defect identified as the liquid styrene defect.

It has been recognized that a low volume fraction, continuous, higher modulus silicon phase in the eutectic intermingled with a continuous aluminum alloy matrix phase, as in a hypereutectic aluminum-silicon alloy, can benefit fatigue resistance even though ductility and impact resistance are unfavorably impacted. It is believed that the low volume, continuous silicon fraction, effectively partitions the continuous aluminum phase into effective "semi-continuous" cells, because the higher modulus silicon phase provides a natural barrier to fatigue crack propagation because of its influence on the plastic zone in front of an advancing crack. Nucleation of the fatigue crack is also hindered because the eutectic silicon phase has a higher modulus and reinforces the aluminum. The silicon-fiber reinforcement in the microstructure carries a greater proportion of the load than its silicon volume fraction and gives the alloy an endurance limit that alloys with unreinforced aluminum in the microstructure do not have, such as hypoeutectic aluminum-silicon alloys. Having identified the unreinforced aluminum dendrites as the weak link in the fatigue chain, it is reasonable to expect die cast hypereutectic aluminum-silicon alloys that contain aluminum dendrites because of the nonequilibrium cooling in the die casting process to have poorer fatigue properties than evaporable foam cast hypereutectic aluminum-silicon alloys that do not contain the primary aluminum dendrites in the microstructure.

It has been further discovered through the invention that a ternary system that includes the $Mg_2Si$ phase in the eutectic produces improved fatigue resistance over a binary hypereutectic aluminum-silicon phase system. Unlike the continuous silicon phase in the eutectic, the $Mg_2Si$ phase is not continuous and, as such, can act as a crack arrestor, providing essentially a shock absorbing breaker to a potential low energy, fracture path through the continuous silicon network. Thus, the islands of a $Mg_2Si$ network interdispersed within the binary eutectic network provide a substantial increase in the fatigue resistance of the alloy.

As an example, an as-cast hypereutectic aluminum silicon alloy containing 18.9% silicon and 1.8% magnesium had a yield strength of 25,000 psi and an elongation of 1% and a fatigue strength of 10,000 psi, at $5\times10^{-8}$ cycles in the R. R. Moore rotating beam test. The same high magnesium alloy heat treated by solution heating at 985° F., quenching to room temperature, and aging at 315° F. had a yield strength of 38,000 psi, an elongation of 1%, and a fatigue strength of 13,000 psi. In contrast, a hypereutectic aluminum-silicon alloy having a low magnesium content of 0.65% and a silicon content of 18.8% had an as cast fatigue strength of 9,000 psi and a fatigue strength in the heat treated state of 12,000 psi.

Thus, it has been discovered unexpectedly that a high magnesium content in a hypereutectic aluminum-silicon alloy and the resulting formation of $Mg_2Si$ in the eutectic, provides an increase in fatigue strength of the as cast as well as in the heat treated alloy.

Various modes of carrying out the invention are contemplated as being within the scope of the following claims particularly pointing out and distinctly claiming the subject matter which is regarded as the invention.

We claim:

1. An evaporable foam cast aluminum silicon article comprising an alloy containing from 16% to 19.5% by weight of silicon, 0.75% to 5.0% by weight of magnesium, and the balance aluminum, said alloy in the molten state during casting having a magnesium oxide film on the surface when exposed to air and said alloy in the solid state having a metallographic structure consisting of primary silicon particles disposed in a eutectic, said magnesium being present in an amount in excess of its solid solubility limit in said alloy and being present in an $Mg_2Si$ phase in the eutectic.

2. The alloy of claim 1, wherein said eutectic comprises a continuous silicon phase and a matrix of a continuous aluminum phase, wherein said continuous higher modulus silicon phase provides reinforcement to the lower modulus aluminum alloy phase and carries a higher fraction of the load than its silicon volume fraction content.

3. A method of casting an article, comprising the steps of positioning a polymeric foam pattern having a configuration proportionally identical to an article to be cast in an outer mold, disposing a flowable finely divided inert material around the pattern in the mold, forming a hypereutectic aluminum-silicon alloy containing from 16% to 19.5% by weight of silicon and containing magnesium in an amount in excess of its solid solubility limit in said alloy, introducing the molten alloy into the mold and forming a magnesium oxide film on the leading edge of said molten alloy, contacting said leading edge with the pattern to vaporize the pattern with the vapor being entrapped within the finely divided material and the molten alloy occupying the void created by vaporization of the pattern to produce a cast article and solidifying the alloy to produce a cast article containing precipitated primary silicon particles disposed in an eutectic, said eutectic being partially modified by the addition of said excess magnesium to produce an $Mg_2Si$ phase.

4. The method of claim 3, and including the step of feeding the molten alloy into the mold through a plurality of ingates.

5. A method of casting an engine block for an internal combustion engine, comprising the steps of forming a polymeric foam pattern having a configuration proportionally identical to the engine block to be cast, positioning the pattern in an outer mold and surrounding the pattern with a finely divided flowable inert material, producing a molten aluminum-silicon alloy containing from 16% to 19.5% by weight of silicon, from 0.75% to 5.0% by weight magnesium in an amount in excess of its solid solubility limit and the balance aluminum, introducing the molten alloy into the mold with the excess magnesium forming a film of magnesium oxide on the leading edge of said molten alloy, bringing said leading edge into contact with the pattern to initially liquify and then vaporize the pattern with the vapor being entrapped within the interstices of the material and the molten alloy filling the void created by vaporization of the pattern, said film of magnesium oxide retarding the solidification of said molten alloy to permit the liquid products of decomposition of said pattern to vaporize before solidification of the molten alloy, and solidifying the alloy to produce a cast engine block containing primary silicon particles disposed in a eutectic having a $Mg_2Si$ phase, said cast engine block being substantially free of a liquid styrene defect.

6. The method of claim 5, and including the step of coating the pattern with a porous ceramic coating before positioning the pattern in said mold.

7. The method of claim 5, wherein the molten alloy has the following composition in weight percent:

| | |
|---|---|
| Silicon | 16.0%-19.50% |
| Magnesium | 0.75%-5.0% |
| Iron | Less than 1.45% |
| Manganese | Less than 0.30% |
| Copper | Less than 0.25% |
| Aluminum | Balance. |

8. The method of claim 5, wherein the molten alloy has the following composition in weight percent:

| | |
|---|---|
| Silicon | 17.0%-19.50% |
| Magnesium | 0.8%-3.0% |
| Iron | Less than 1.4% |
| Manganese | Less than 0.3% |
| Copper | Less than 0.37% |
| Aluminum | Balance. |

9. A cast aluminum silicon article comprising an alloy containing from 16% to 19.5% by weight of silicon, 0.75% to 5.0% by weight of magnesium, and the balance aluminum, said alloy having a metallographic structure consisting of primary silicon particles disposed in a eutectic, said magnesium being present in an amount in excess of its solubility limit in said alloy and being present in an $Mg_2Si$ phase in the eutectic, said cast article being produced by positioning a polymeric foam pattern having a configuration proportionally identical to the article to be cast in an outer mold, disposing a flowable finely divided inert material around the pattern in the mold, preparing a molten hypereutectic aluminum silicon alloy containing from 16% to 19.5% by weight of silicon, 0.75% to 5.0% by weight of magnesium and the balance aluminum, maintaining the magnesium content above its solubility limit in the alloy, introducing the molten alloy into the mold and reacting the magnesium in excess of its solid solubility limit with oxygen to form a film of magnesium oxide on the leading edge of said molten alloy, contacting the pattern with said leading edge to initially liquify and then vaporize the pattern with the vapor being entrapped within the finely divided material and the molten alloy occupying the void created by vaporization of the pattern, said film of magnesium oxide retarding the solidification of said molten alloy to permit the liquid product of decomposition of said pattern to vaporize before solidification of the molten alloy, and solidifying the alloy to produce said cast article.

10. A heat treated evaporable foam cast aluminum silicon article comprising an alloy containing from 16% to 19.5% by weight of silicon, 0.75% to 3.0% by weight of magnesium, and the balance aluminum, said alloy having a metallographic structure consisting of primary silicon particles disposed in a eutectic, said magnesium being present in an amount in excess of its solubility limit in said alloy and being present in an $Mg_2Si$ phase in the eutectic, said alloy being heat treated by heating the cast alloy to a temperature of about 920° F. to 1000° F., quenching the alloy, and thereafter aging the alloy at a temperature range of 300° F. to 450° F., said heat treated alloy having a fatigue strength of about 12,000 psi at $5\times10^{-8}$ cycle in a R. R. Moore rotating beam test.

* * * * *